US007468020B2

(12) United States Patent
Lai

(10) Patent No.: US 7,468,020 B2
(45) Date of Patent: Dec. 23, 2008

(54) FOLDABLE TRAMPOLINE

(76) Inventor: Fen-Ying Lai, Room 39, 2F, No. 2, Kung-Yuan Rd., Chung Dist., Taichung City (TW)

( * ) Notice: Subject to any disclaimer, the term of this patent is extended or adjusted under 35 U.S.C. 154(b) by 62 days.

(21) Appl. No.: 11/328,260

(22) Filed: Jan. 10, 2006

(65) Prior Publication Data

US 2007/0072738 A1 Mar. 29, 2007

(30) Foreign Application Priority Data

Sep. 26, 2005 (TW) ..... 94216544 U

(51) Int. Cl.
*A63B 5/11* (2006.01)
*E05D 11/10* (2006.01)

(52) U.S. Cl. ..... 482/28; 482/27; 16/324

(58) Field of Classification Search ..... 482/27–29; 285/229, 320; 403/61, 113, 330; 280/642; 16/324, 326

See application file for complete search history.

(56) References Cited

U.S. PATENT DOCUMENTS 1,447,565 A * 3/1923 Nosan ..... 403/61
2,066,182 A * 12/1936 Lenz ..... 403/100
2,799,867 A * 7/1957 Fenner et al. ..... 482/28
2,969,124 A * 1/1961 Nissen ..... 482/28
3,276,544 A * 10/1966 Hall ..... 482/28
4,045,021 A * 8/1977 Nissen ..... 482/29
4,415,151 A * 11/1983 Daniels ..... 482/28
4,502,807 A * 3/1985 Salice ..... 403/11
4,632,595 A * 12/1986 Schaeff ..... 403/330
4,900,011 A * 2/1990 Nolet ..... 482/29
4,969,660 A * 11/1990 Spak ..... 280/646
5,545,110 A * 8/1996 Hsiang ..... 482/27
5,890,263 A * 4/1999 Wu ..... 16/324
2005/0130804 A1* 6/2005 Hall ..... 482/28
2005/0137061 A1* 6/2005 Wang et al. ..... 482/28
2006/0189441 A1* 8/2006 VanElverdinghe et al. .... 482/27

* cited by examiner

*Primary Examiner*—LoAn H. Thanh
*Assistant Examiner*—Sandhara M Ganesan
(74) *Attorney, Agent, or Firm*—Pillsbury Winthrop Shaw Pittman LLP

(57) ABSTRACT

A foldable trampoline includes a bed unit, and a foldable frame unit operable to move between unfolded and folded states, and including first and second frame sections that cooperate to define a bedding space, that are coupled movably to each other and to the bed unit, and that include first and second end parts, respectively. The first end part has a coupling edge formed with a coupling notch, and a guiding edge extending from the coupling edge and formed with a securing notch. The second end part is provided with a coupling shaft to be received movably in the coupling notch, and a securing shaft to be received in the securing notch. The coupling and securing shafts cooperate with the coupling and securing notches to secure the foldable frame unit in the unfolded state, where the bed unit is stretched tensely over the bedding space.

8 Claims, 15 Drawing Sheets

FOLDABLE TRAMPOLINE

CROSS-REFERENCE TO RELATED APPLICATION

This application claims priority of Taiwanese Application No. 094216544, filed on Sep. 26, 2005.

BACKGROUND OF THE INVENTION

1. Field of the Invention

The invention relates to fitness equipment, more particularly to a foldable trampoline.

2. Description of the Related Art

As shown in FIG. 1, a conventional foldable trampoline includes a bed unit 2 and a foldable frame unit 3.

The bed unit 2 includes a bed body 201 and a plurality of anchoring components 202 connected to a periphery of the bed body 201. The foldable frame unit 3 is operable to move between an unfolded state (not shown) and a folded state (as shown in FIG. 2), and includes first and second frame sections 30, 31 that cooperate to define a bedding space 32, that are coupled movably to each other, that have the anchoring components 202 of the bed unit 2 coupled thereto, and that include first and second end parts 302, 312, respectively. The foldable frame unit 3 further includes a connecting shaft 33 extended removably through the first and second end parts 302, 312 of the first and second frame sections 30, 31 for securing the foldable frame unit 3 in the unfolded state, and a plurality of supporting legs 34 connected removably to the first and second frame sections 30, 31.

The first frame section 30 includes a pair of first frame rods 301, each of which has one end pivoted to the other one of the first frame rods 301, and another end provided with the first end part 302. The first end part 302 includes a pivot shaft 303 and a first opening 304. Similarly, the second frame section 31 includes a pair of second frame rods 311, each of which has one end pivoted to the other one of the second frame rods 311, and another end provided with the second end part 312. The second end part 312 includes a pivot plate 313 connected rotatably to the pivot shaft 303, and a second opening 314 aligned with the first opening 304.

With further reference to FIG. 2, when the foldable frame unit 3 is operated to move from the folded state to the unfolded state, a user 7 needs to exert forces on the first and second frame sections 30, 31 such that the first and second frame sections 30, 31 pivot away from each other in direction (A), such that the bed body 201 of the bed unit 2 is stretched tensely over the bedding space 32, and such that the first and second openings 304, 314 are aligned with each other. The user 7 then extends the connecting shaft 33 through the first and second openings 304, 314 in direction (B) to secure the foldable frame unit 3 in the unfolded state.

However, when the user 7 exerts forces on the first and second frame sections 30, 31 to dispose the foldable frame unit 3 in the unfolded state, a restoring force is stored in the stretched bed unit 2 that tends to resist unfolding of the foldable frame unit 3. Before the connecting shaft 33 secures the foldable frame unit 3 in the unfolded state to overcome the restoring force, the first and second frame sections 30, 31 are vulnerable to move back to the folded state. As a result, the operation of disposing the foldable frame unit 3 from the folded state to the unfolded state is dangerous for the user 7.

SUMMARY OF THE INVENTION

Therefore, the object of the present invention is to provide a trampoline having a foldable frame unit, the operation of which from a folded state to an unfolded state being safe and easy to conduct.

According to the present invention, there is provided a foldable trampoline that includes a bed unit and a foldable frame unit. The bed unit includes a bed body and a plurality of anchoring components connected to a periphery of the bed body. The foldable frame unit is operable to move between an unfolded state and a folded state, and includes first and second frame sections that cooperate to define a bedding space, that are coupled movably to each other, that have the anchoring components of the bed unit coupled thereto, and that include first and second end parts, respectively. The bed body of the bed unit is stretched tensely over the bedding space when the foldable frame unit is in the unfolded state. The first end part of the first frame section has a coupling edge indented to form a coupling notch that opens in a direction away from the bed body, and a guiding edge extending from the coupling edge and indented to form a securing notch that opens toward the second end part of the second frame section when the foldable frame unit is in the unfolded state. The second end part of the second frame section is provided with a coupling shaft to be received movably in the coupling notch in the coupling edge of the first end part of the first frame section, and a securing shaft to be received in the securing notch in the guiding edge of the first end part of the first frame section. When the coupling shaft is extended into the coupling notch, and the foldable frame unit is operated to move from the folded state to the unfolded state, the securing shaft is guided along the guiding edge of the first end part of the first frame section and is subsequently received in the securing notch such that the coupling shaft and the securing shaft cooperate with the first end part of the first frame section to secure the foldable frame unit in the unfolded state.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
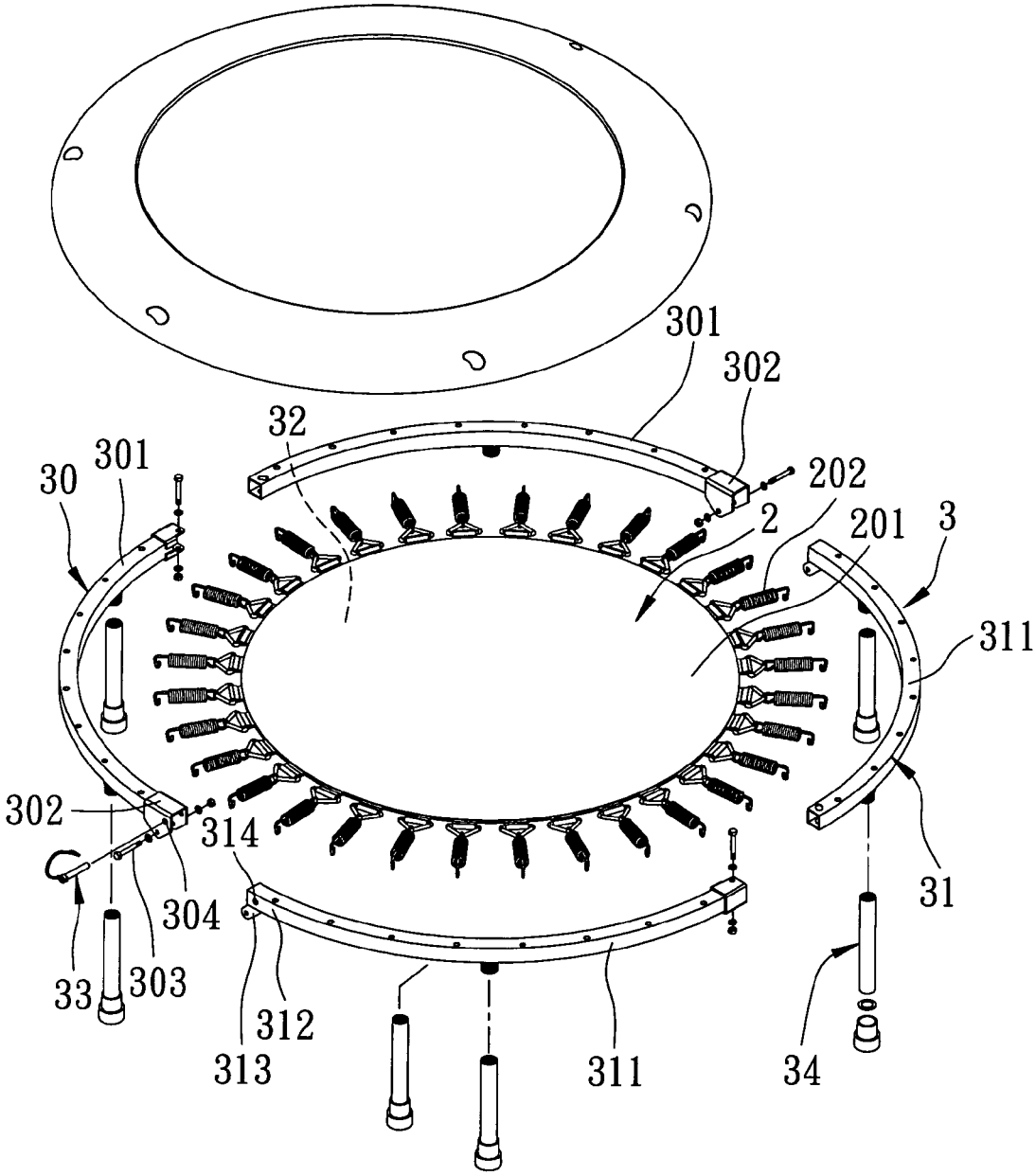
FIG. 1 PRIOR ART
FIG. 1 is an exploded perspective view of a conventional foldable trampoline.
Figure 2:
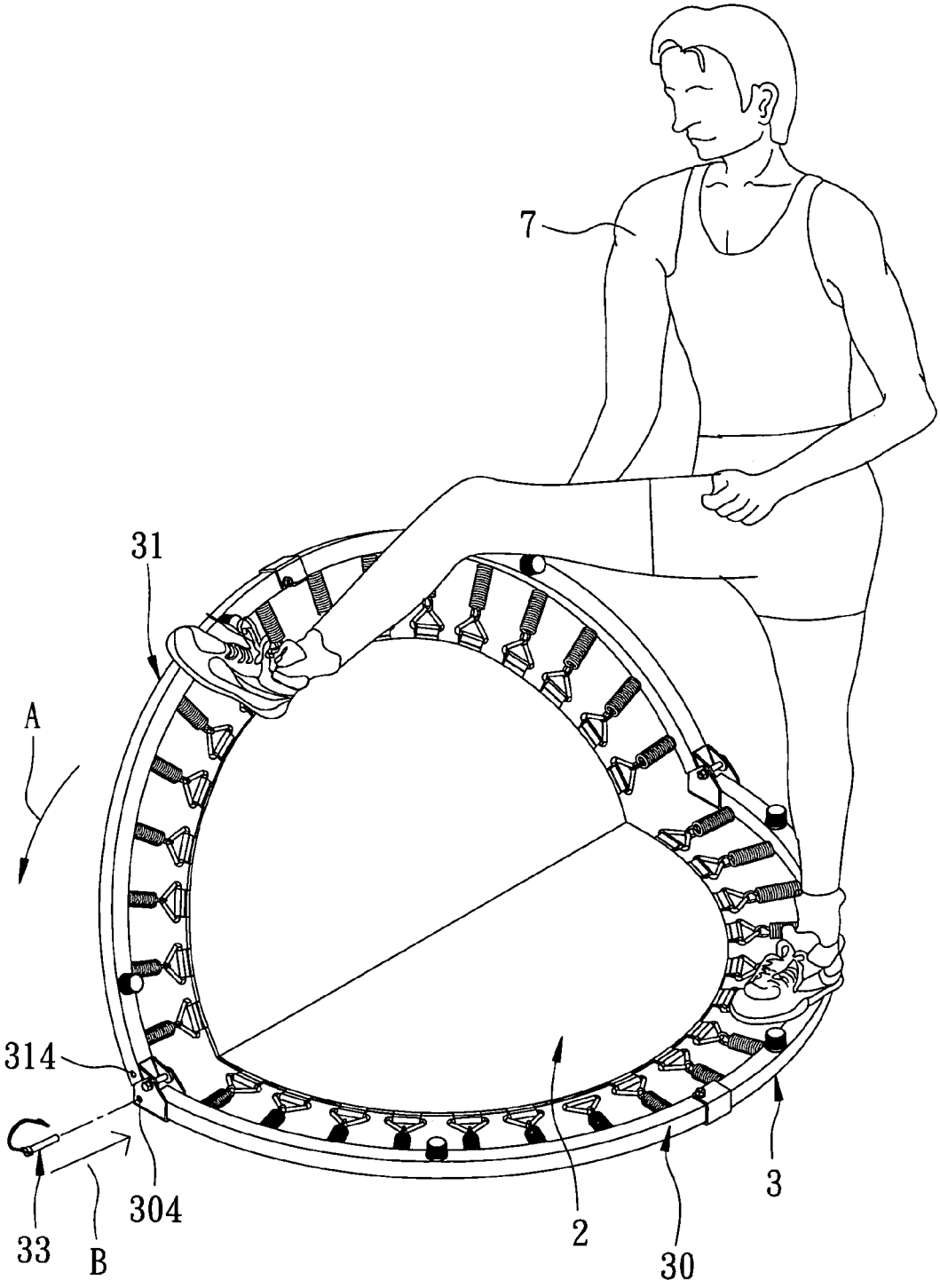
FIG. 2 PRIOR ART
FIG. 2 is a fragmentary perspective view of the conventional foldable trampoline, illustrating an operation of disposing a foldable frame unit from a folded state to an unfolded state.
Figure 3:
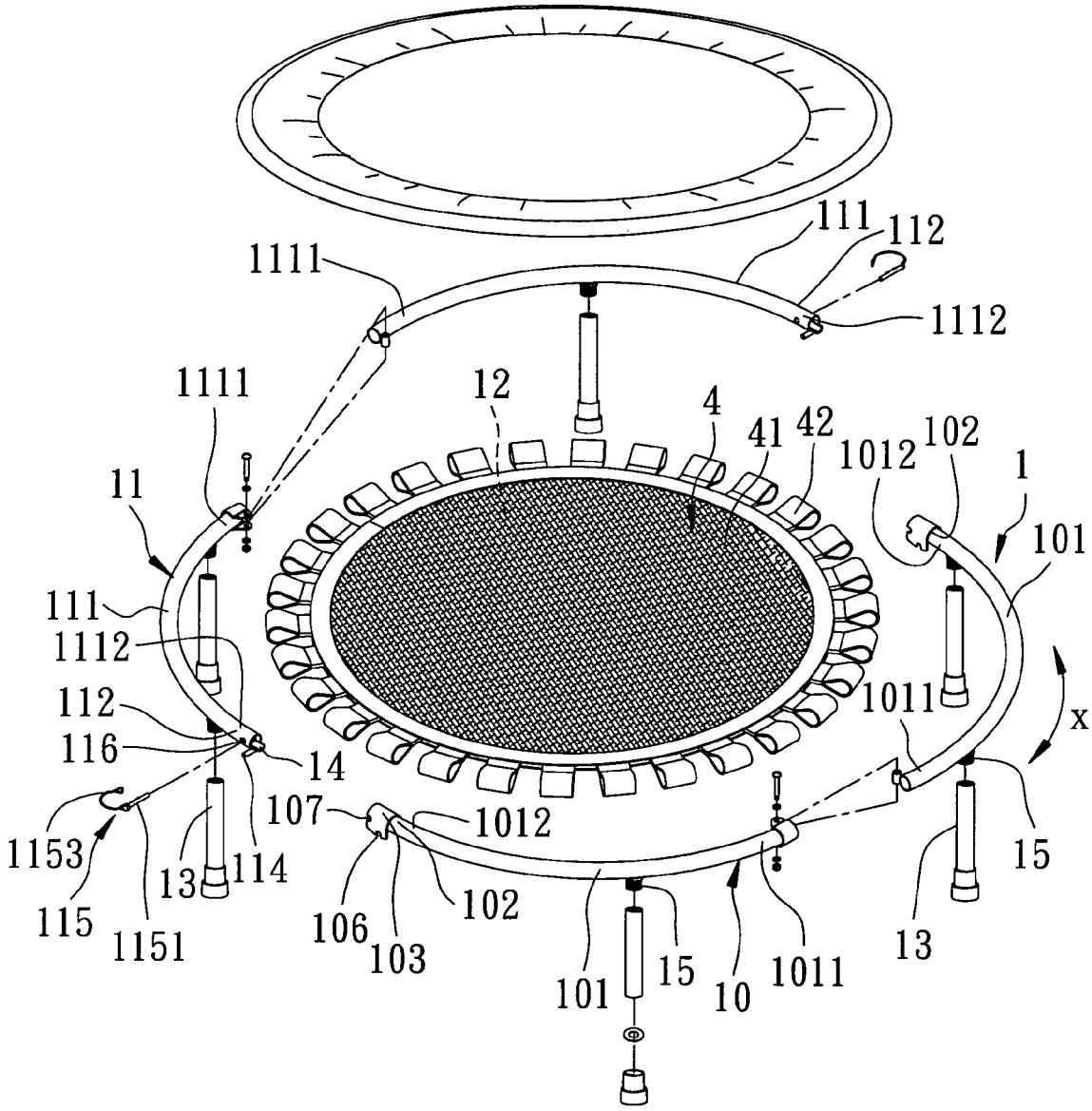
FIG. 3 is an exploded perspective view of the preferred embodiment of a foldable trampoline according to the present invention.
Figure 4:
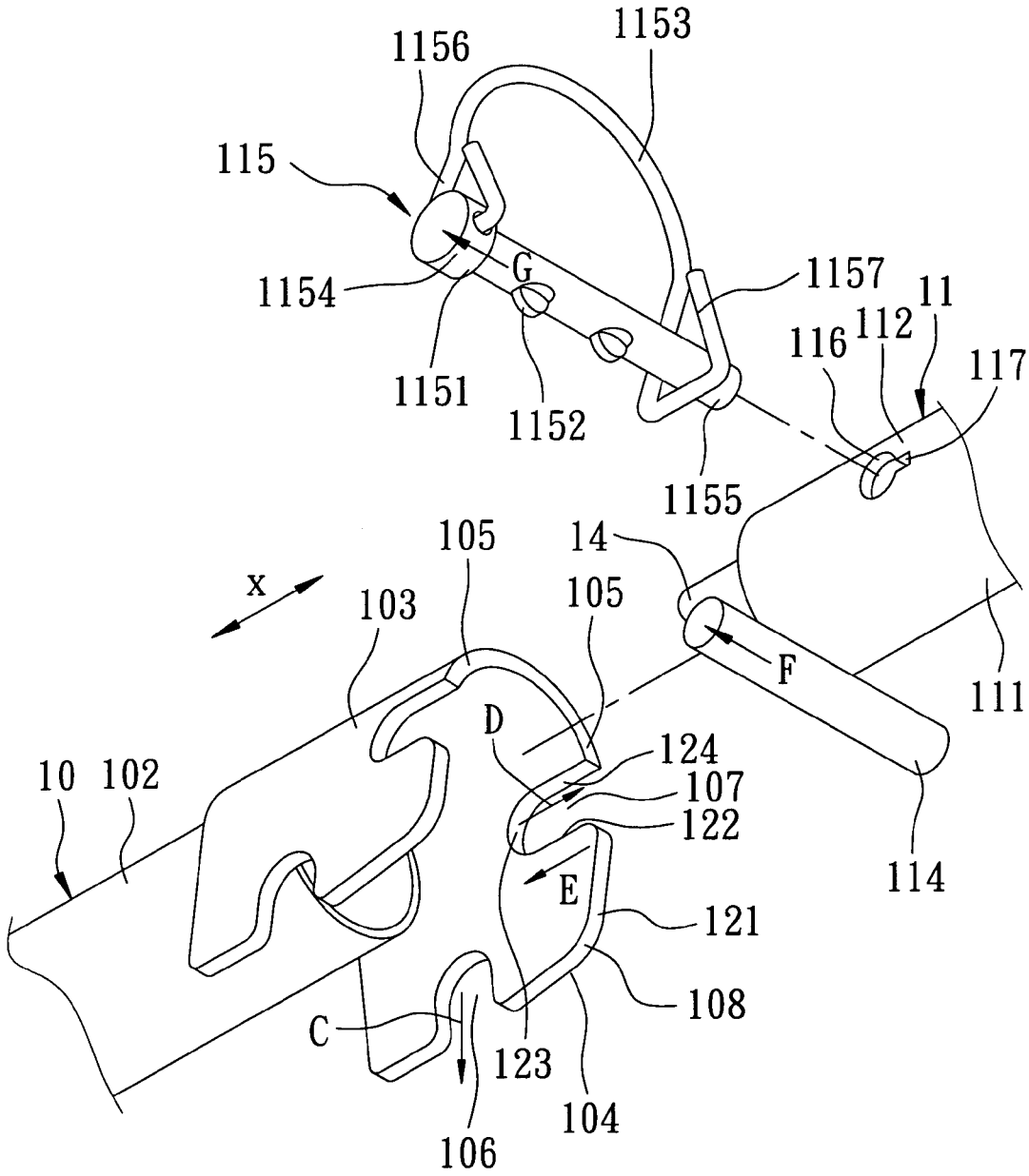
FIG. 4 is an enlarged fragmentary exploded perspective view to illustrate first and second end parts of first and second frame sections of a foldable frame unit of the preferred embodiment.

As shown in FIG. 3 and FIG. 4, the preferred embodiment of a foldable trampoline according to the present invention includes a bed unit 4 and a foldable frame unit 1.

The bed unit 4 includes a bed body 41 and a plurality of anchoring components 42 connected to a periphery of the bed body 41.

Figure 13:
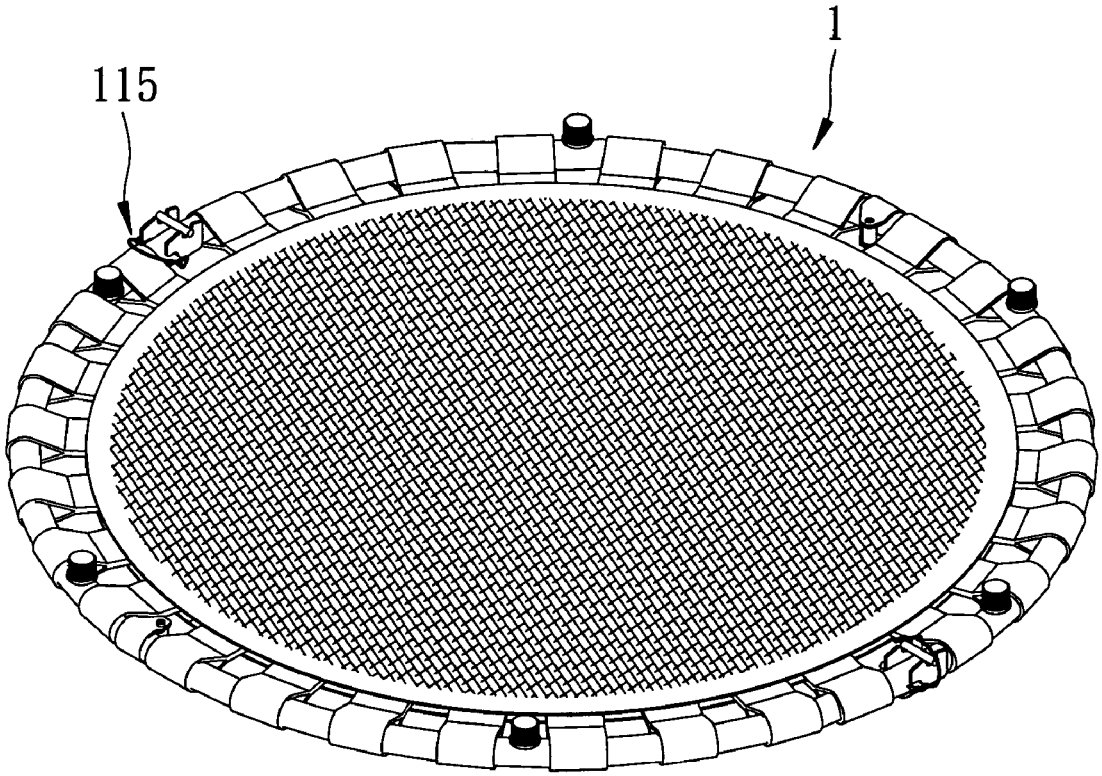
FIG. 13 is a fragmentary perspective view of the preferred embodiment, illustrating the foldable frame unit in the unfolded state.
Figure 15:
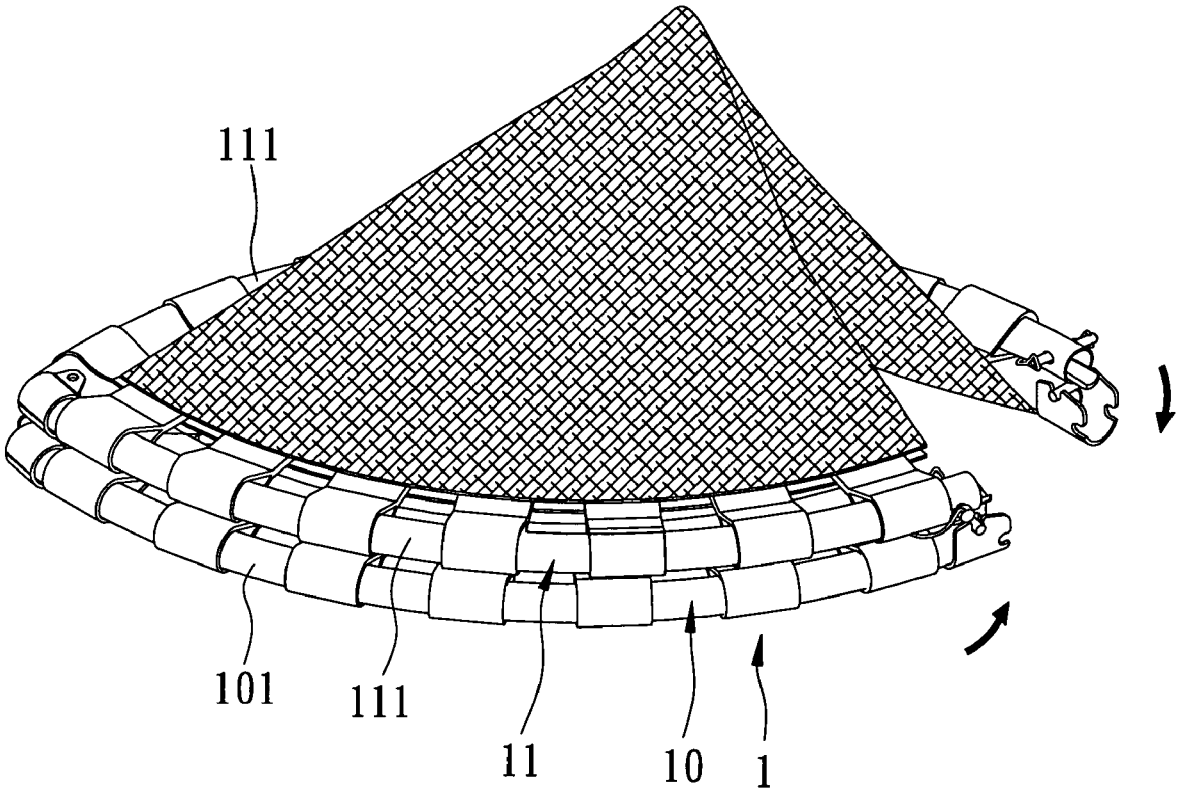
FIG. 15 is a perspective view of the preferred embodiment, illustrating the foldable frame unit in the fully folded state.

The foldable frame unit 1 is operable to move between an unfolded state (as shown in FIG. 13) and a fully folded state (as shown in FIG. 15), and includes first and second frame sections 10, 11 that extend in an annular direction (X), that cooperate to define a bedding space 12, that are coupled movably to each other, and that have the anchoring components 42 of the bed unit 4 coupled thereto. The foldable frame unit 1 further includes a plurality of leg-mounting seats 15 provided on the first and second frame sections 10, 11 and projecting transversely of the bedding space 12, and a plurality of supporting legs 13 mounted on the leg-mounting seats 15, respectively. In this embodiment, the leg-mounting seats 15 are internally threaded members, and the supporting legs 13 are connected detachably to the leg-mounting seats 15. The bed body 41 of the bed unit 4 is stretched tensely over the bedding space 12 when the foldable frame unit 1 is in the unfolded state. The bedding space 12 is circular in this embodiment, but it can be rectangular or square in other embodiments of the present invention.

In this embodiment, the anchoring components 42 are in the form of elastic plaits and are sleeved on the first and second frame sections 10, 11. The anchoring components 42 can also be in the form of springs in other embodiments of the present invention. The first frame section 10 includes a pair of first frame rods 101 and a pair of first end parts 102. Each of the first frame rods 101 has a first inner end 1011 and a first outer end 1012. The first inner ends 1011 of the first frame rods 101 are connected pivotally to each other. The first outer ends 1012 of the first frame rods 101 are provided with the first end parts 102, respectively. Similarly, the second frame section 11 includes a pair of second frame rods 111 and a pair of second end parts 112. Each of the second frame rods 111 has a second inner end 1111 and a second outer end 1112. The second inner ends 1111 of the second frame rods 111 are connected pivotally to each other. The second outer ends 1112 of the second frame rods 111 are provided with the second end parts 112, respectively.

It should be noted herein that since the feature of the present invention does not reside in the specific connection between the first frame rods 101, or between the second frame rods 102, the same should not limit the scope of the present invention. Moreover, the first and second frame sections 10, 11 may include only one of the first frame rods 101 and one of the second frame rods 111, respectively, in other embodiments of the present invention.

As shown in FIG. 4, each of the first and second end parts 102, 112 of the first and second frame sections 10, 11 is tubular. Each of the first end parts 102 of the first frame section 10 is provided with an inverted-U-shaped bracket 103. The inverted-U-shaped bracket 103 has a pair of coupling edges 104, each of which extends along the annular direction (X), and is indented to form a coupling notch 106 that opens in a direction (C) away from the bed body 41. The inverted-U-shaped bracket 103 further has a pair of guiding edges 105, each of which extends from a respective one of the coupling edges 104 and is indented to form a securing notch 107 that opens in a direction (D) toward a respective one of the second end parts 112 of the second frame section 11 when the foldable frame unit 1 is in the unfolded state. The coupling notches 106 in the coupling edges 104 are aligned with each other, and the securing notches 107 in the guiding edges 105 are aligned with each other. The inverted-U-shaped bracket 103 further has a rounded corner 108 between each of the coupling edges 104 and the respective one of the guiding edges 105.

Each of the guiding edges 105 of the inverted-U-shaped bracket 103 of each of the first end parts 102 of the first frame section 10 has a guide segment 121 extending from the respective one of the coupling edges 104, a first notch-confining segment 122 extending from the guide segment 121 in a direction (E) away from the respective one of the second end parts 112 of the second frame section 11 when the foldable frame unit 1 is in the unfolded state, a notch end segment 123 extending from the first notch-confining segment 122, and a second notch-confining segment 124 extending from the notch end segment 123 in the direction (D) toward the respective one of the second end parts 112 of the second frame section 11 when the foldable frame unit 1 is in the unfolded state.

The first and second notch-confining segments 122, 124 cooperate with the notch end segment 123 to define the respective securing notch 107.

Preferably, the first notch-confining segment 122 is inclined relative to the second notch-confining segment 124 such that the securing notch 107 gradually diverges in the direction (D) toward the respective one of the second end parts 112 of the second frame section 11 when the foldable frame unit 1 is in the unfolded state.

Each of the second end parts 112 of the second frame section 11 is provided with a coupling shaft 114 to be received movably in the coupling notches 106 of the coupling edges 104 of the inverted-U-shaped bracket 103 of a respective one of the first end parts 102 of the first frame section 10, and a securing shaft 115 to be received in the securing notches 107 in the guiding edges 105 of the inverted-U-shaped bracket 103 of the respective one of the first end parts 102 of the first frame section 10. In this embodiment, the coupling shaft 114 and the securing shaft 115 extend transversely to the annular direction (X) and parallel to the bedding space 14 in directions (F), (G), respectively.

Figure 8:
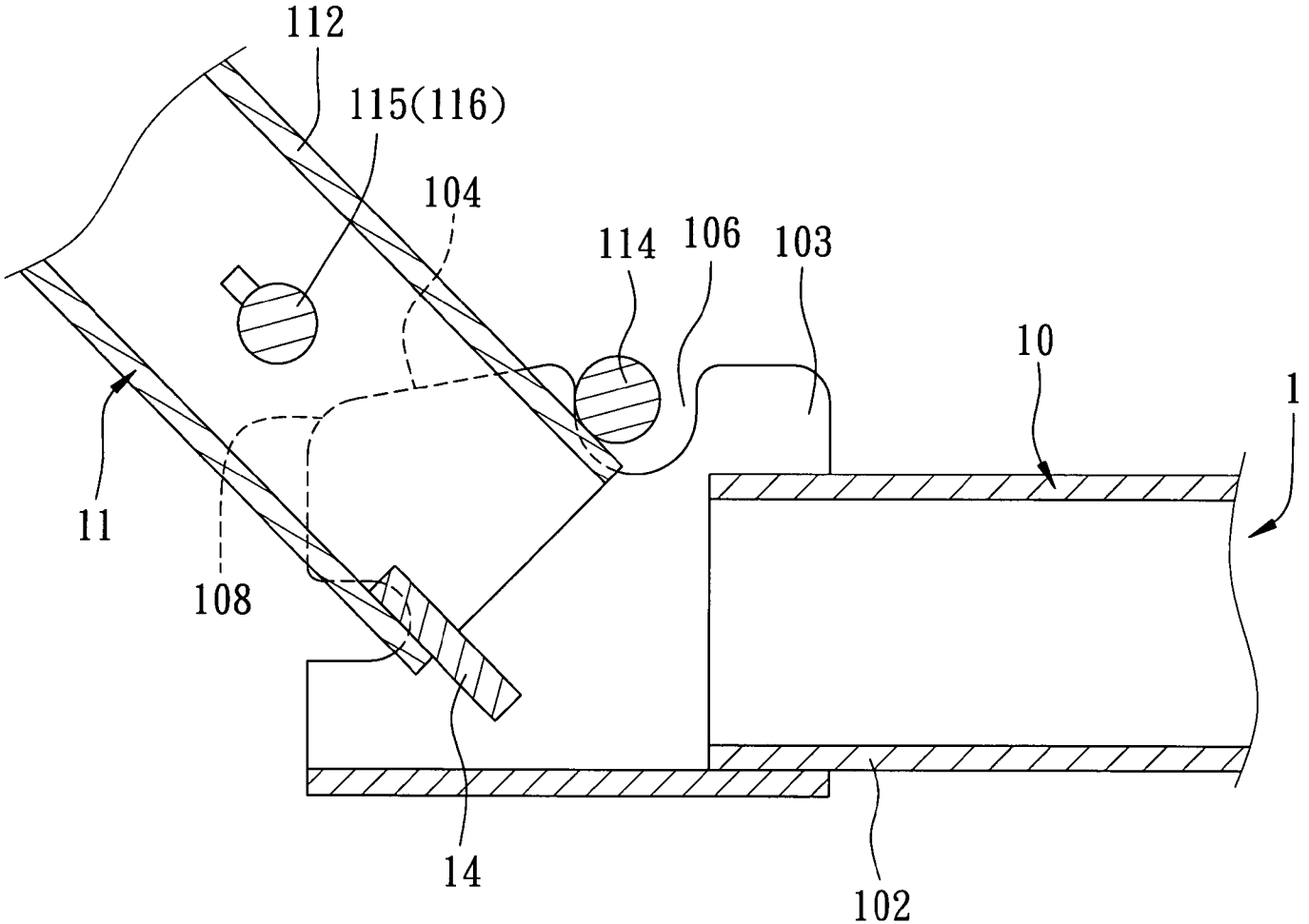
FIG. 8 is a fragmentary sectional view of FIG. 7.

One of the first and second end parts 102, 112 in each pair is preferably provided with a positioning plate 14 that extends into and that abuts against the other one of the first and second end parts 102, 112 when the foldable frame unit 1 is in the unfolded state, as best shown in FIG. 8. In this embodiment, each of the second end parts 112 of the second frame section 11 is provided with the positioning plate 14 that extends into and that abuts against the respective one of the first end parts 102 of the first frame section 10.

When the coupling shaft 114 is extended into the coupling notches 106, and the foldable frame unit 1 is operated to move from the folded state (as shown in FIG. 15) to the unfolded state (as shown in FIG. 13), the securing shaft 115 is guided along the guiding edges 105 of the inverted-U-shaped bracket 103 of the respective one of the first end parts 102 of the first frame section 10 and is subsequently received in the securing notches 107 such that the coupling shaft 114 and the securing shaft 115 cooperate with the respective first end part 102 of the first frame section 10 to secure the foldable frame unit 1 in the unfolded state.

It should be noted herein that the inverted-U-shaped bracket 103 is not a necessary component in other embodiments of the present invention. That is, the coupling edges 104 and the securing edges 105, as well as the coupling notches 106 and securing notches 107, can be formed directly on each of the first end parts 102 of the first frame section 10 in other embodiments of the present invention. In addition, the numbers of the coupling edges 104 and the securing edges 105 can each be one in other embodiments of the present invention.

In this embodiment, the second end part 112 of the second frame section 11 is formed with an aligned pair of securing openings 116 (only one is visible) and two radial nicks 117 (only one is visible) in spatial communication with the securing openings 116, respectively. The securing shaft 115 includes a shaft body 1151 and a plurality of radial securing protrusions 1152 mounted on the shaft body 1151. There are two securing protrusions 1152 on the shaft body 1151 in this embodiment. The shaft body 1151 is operable to extend through the second end part 112 of the second frame section 11 via the securing openings 116 such that the securing protrusions 1152 are extended into the second end part 112 of the second frame section 11 via the nicks 117. The securing protrusions 1152 prevent the shaft body 1151 from moving out of the second end part 112 of the second frame section 11 when the securing protrusions 1152 are misaligned with the nicks 117. In this embodiment, the shaft body 1151 has first and second ends 1154, 1155, and the securing shaft 115 further includes a curved safety pin 1153 having a first pin portion 1156 connected pivotally to the first end 1154 of the shaft body 1151, and a second pin portion 1157 hooked removably onto the second end 1155 of the shaft body 1151.

It should be noted herein that the securing shaft 115 can be formed integrally on the second end part 112 of the second frame section 11 in other embodiments of the present invention.

FIGS. 5 to 11 illustrate consecutive steps of the operation for moving the foldable frame unit 1 from the unfolded state (as shown in FIG. 13) to the folded state (as shown in FIG. 15).

Figure 5:
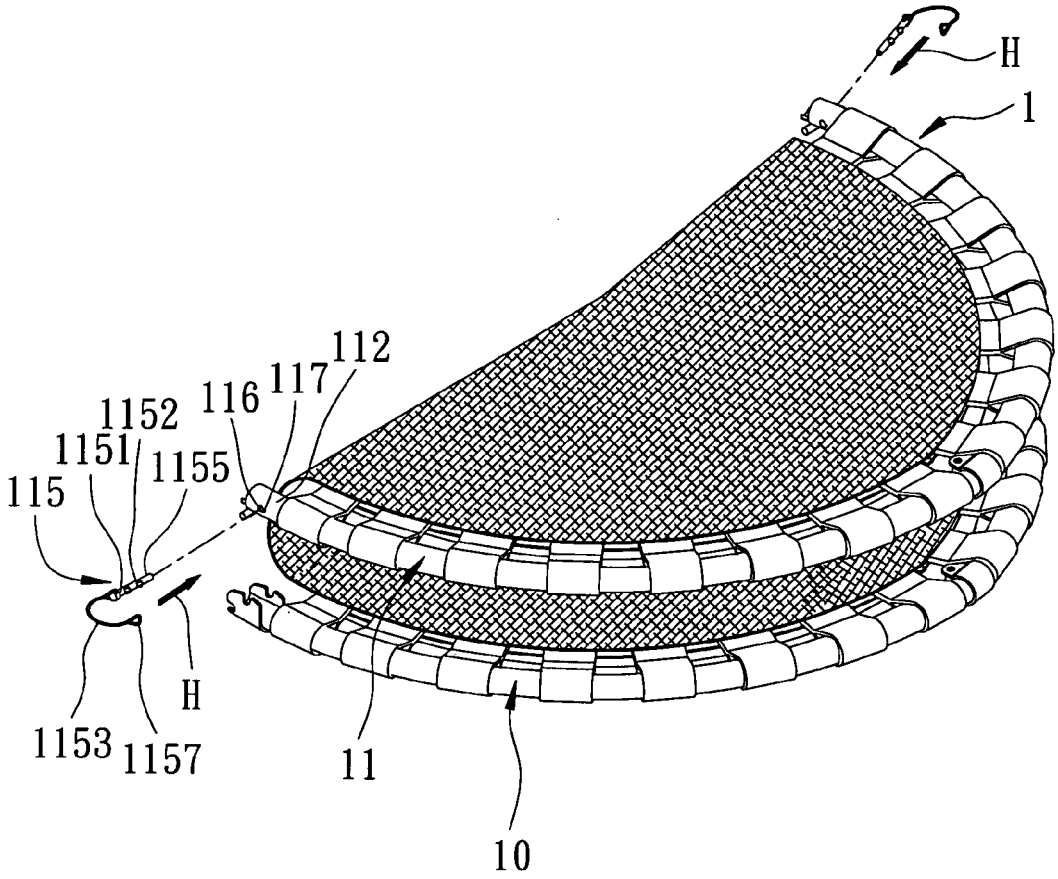
FIG. 5 is a fragmentary perspective view of the preferred embodiment, illustrating a relationship between a securing shaft and a securing opening.
Figure 6:
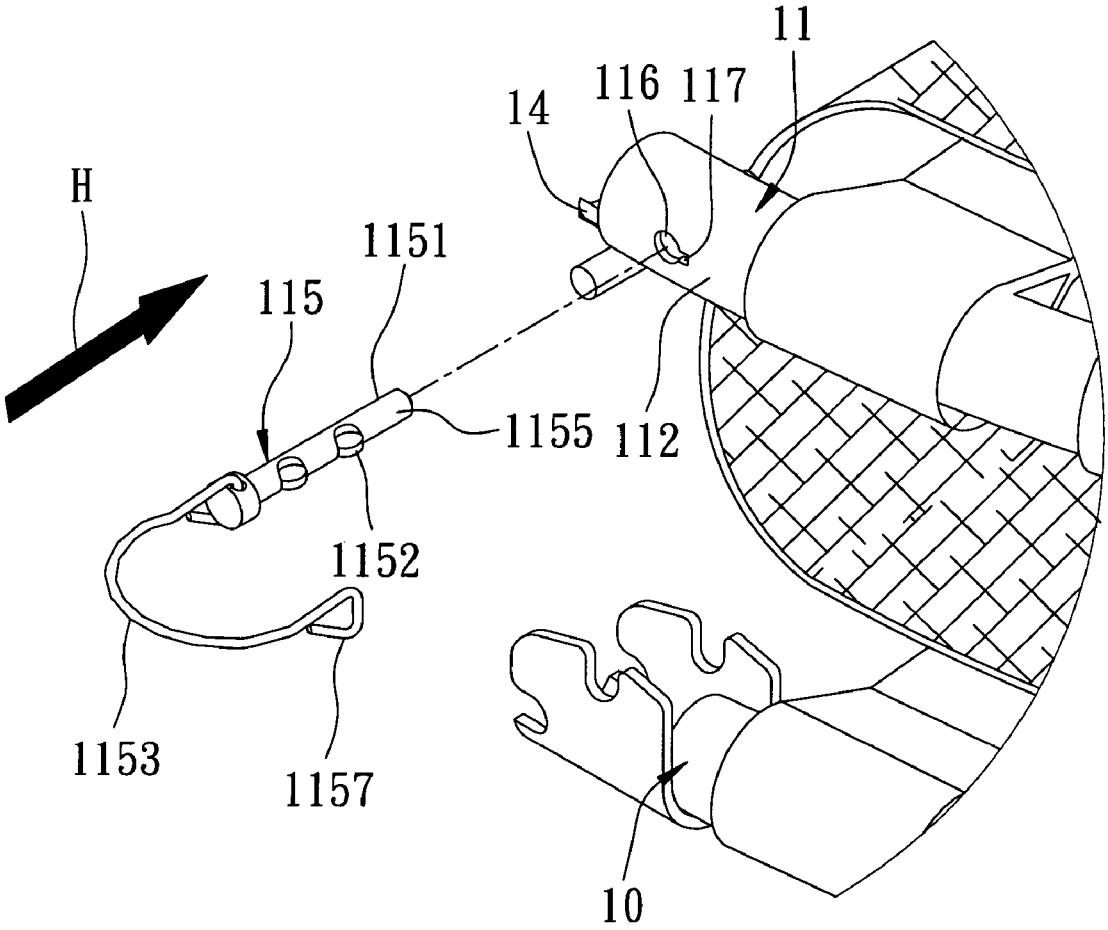
FIG. 6 is an enlarged fragmentary perspective view of FIG. 5.

As shown in FIG. 5 and FIG. 6, each securing shaft 115 is required to be assembled to the respective second end part 112 of the second frame section 11 while the foldable frame unit 1 is in the folded state. The second pin portion 1157 of the safety pin 1153 of the securing shaft 115 is taken off the second end 1155 of the shaft body 1151. The shaft body 1151 is subsequently operated to extend through the second end part 112 of the second frame section 11 via the securing openings 116 in direction (H) such that the securing protrusions 1152 are extended into the second end part 112 of the second frame section 11 via the nicks 117. Next, the shaft body 1151 is turned at an angle such that the securing protrusions 1152 are misaligned with the nicks 117, thereby preventing the shaft body 1151 from moving out of the second end part 112 of the second frame section 11. At this time, the second pin portion 1157 of the safety pin 1153 is hooked back onto the second end 1155 of the shaft body 1151.

Figure 7:
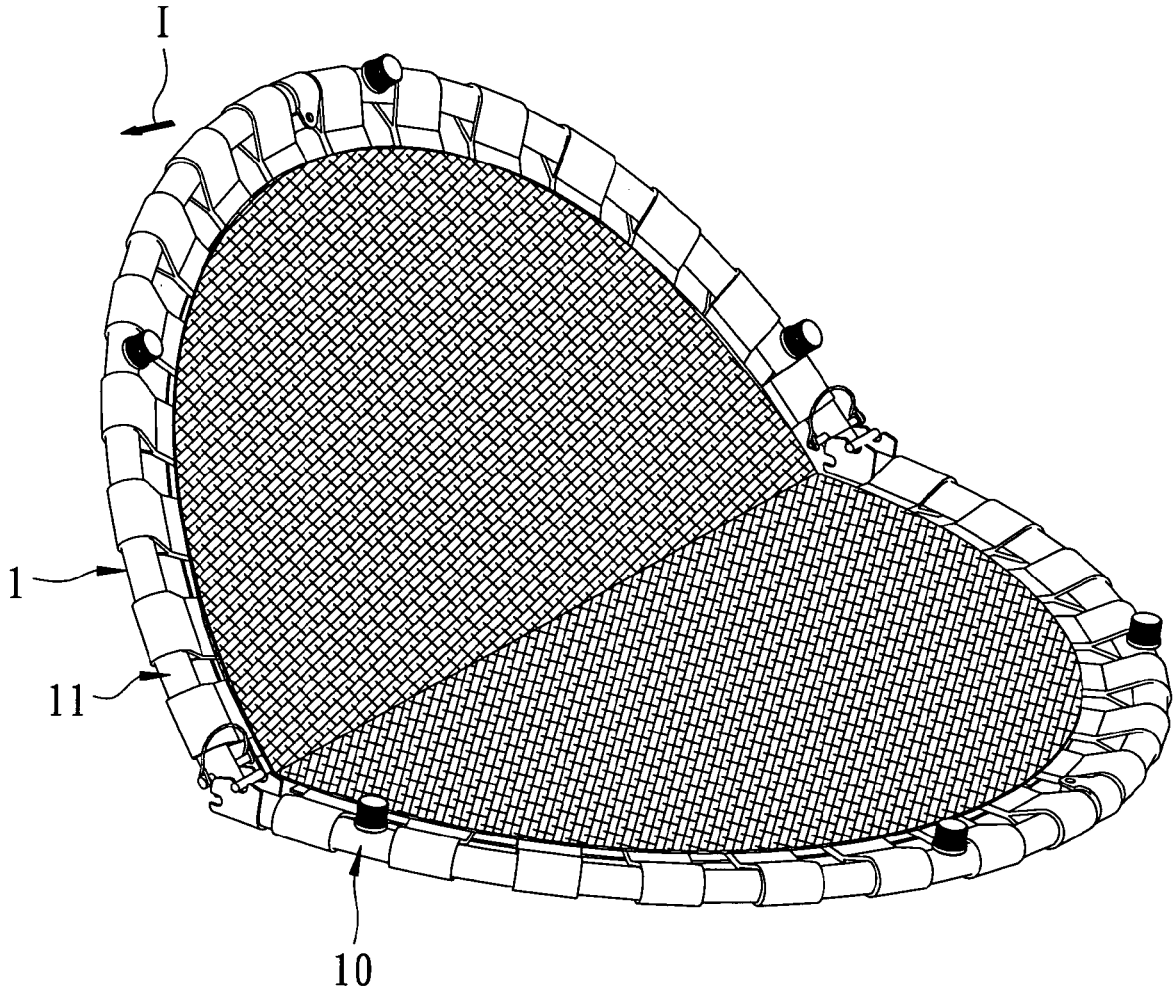
FIG. 7 is a fragmentary perspective view of the preferred embodiment, illustrating a first step in an operation of the foldable frame unit for moving from the folded state to the unfolded state.
Figure 9:
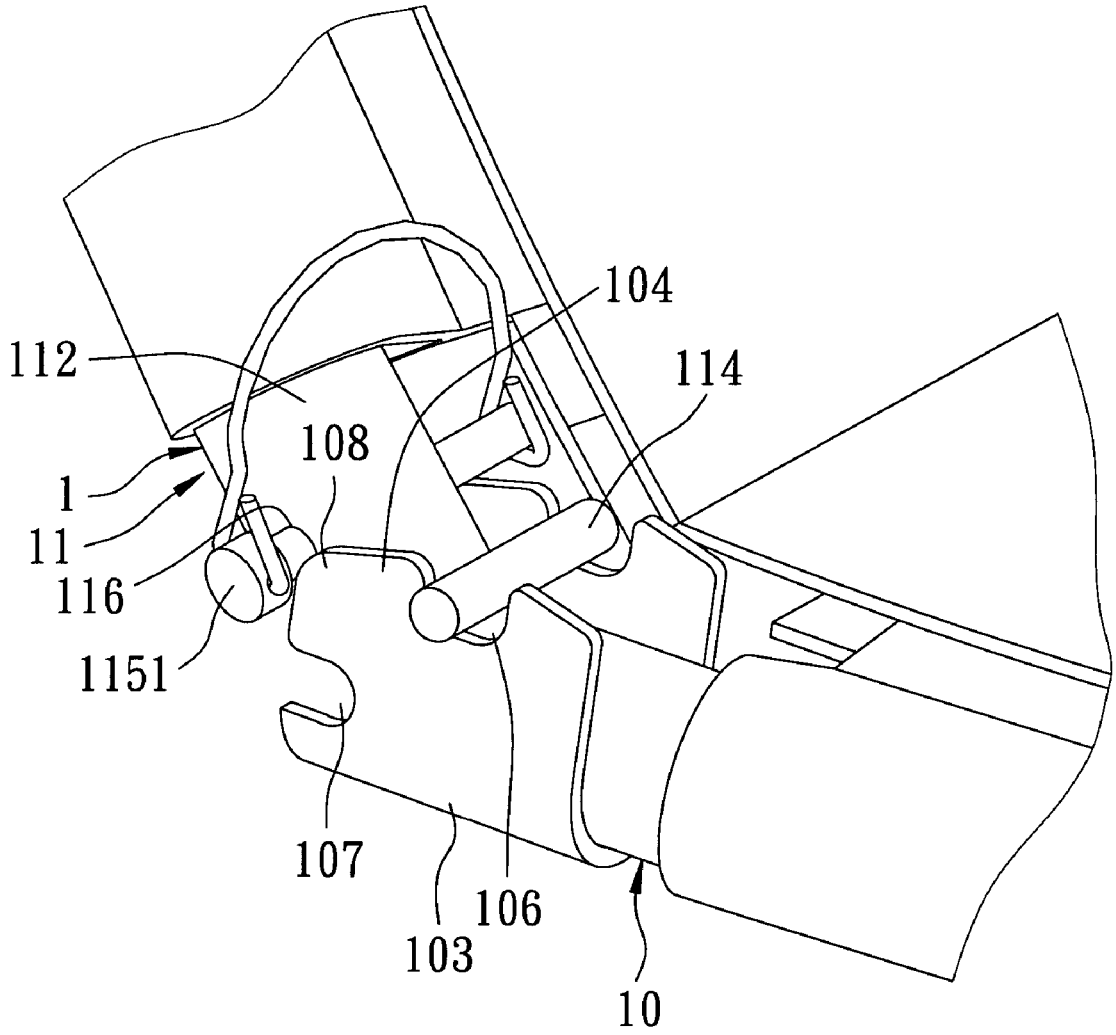
FIG. 9 is an enlarged fragmentary perspective view of FIG. 7.

Next, as shown in FIGS. 7 to 9, the first and second frame sections 10, 11 are pushed away from each other in direction (I) against the restoring force of the bed unit 4, such that the coupling shaft 114 is extended into the coupling notches 106, and the securing shaft 115 is disposed proximate to the rounded corners 108 of the inverted-U-shaped bracket 103.

Figure 10:
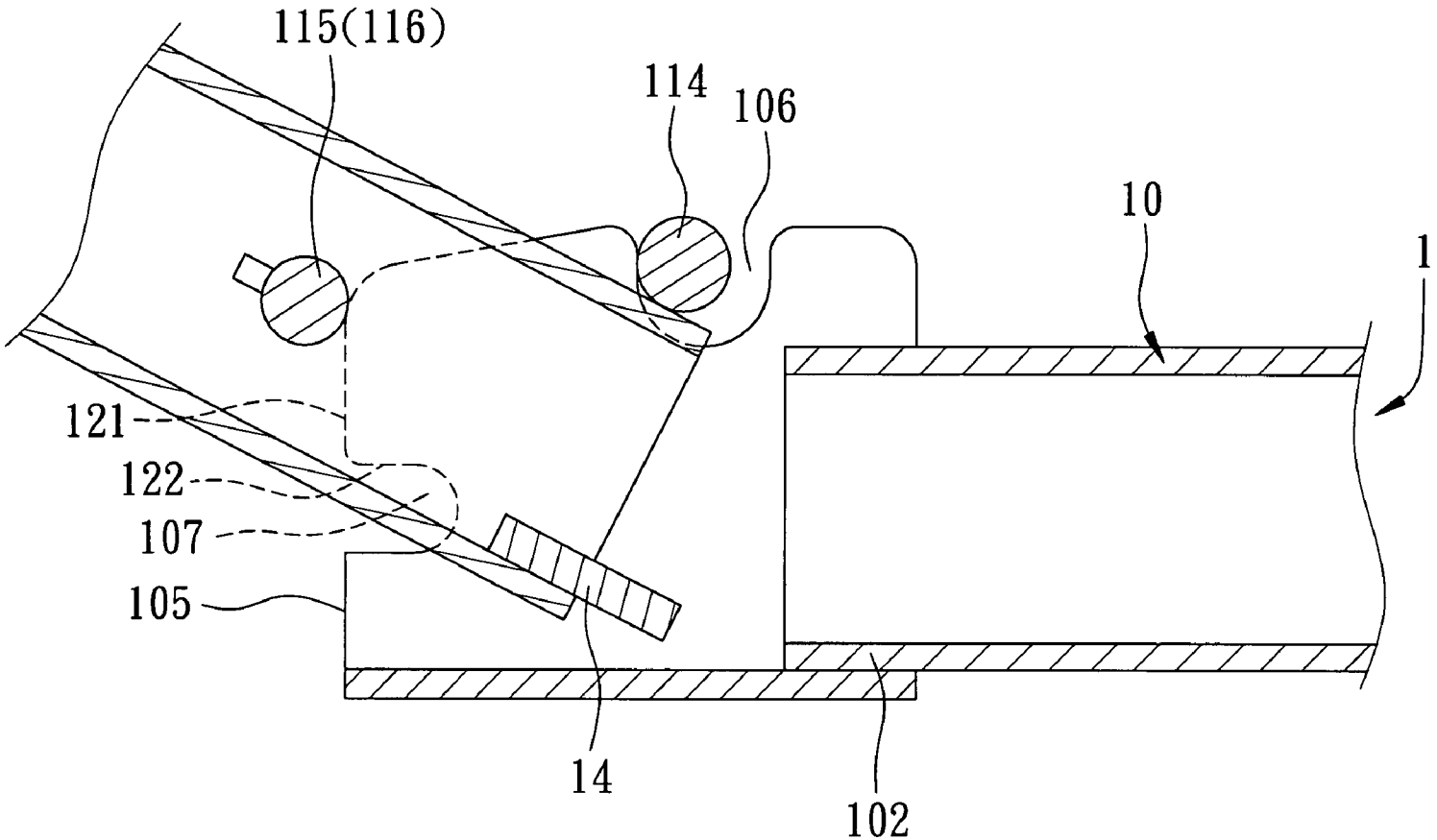
FIG. 10 is a fragmentary sectional view of the preferred embodiment, illustrating a second step in the operation of the foldable frame unit for moving from the folded state to the unfolded state.
Figure 11:
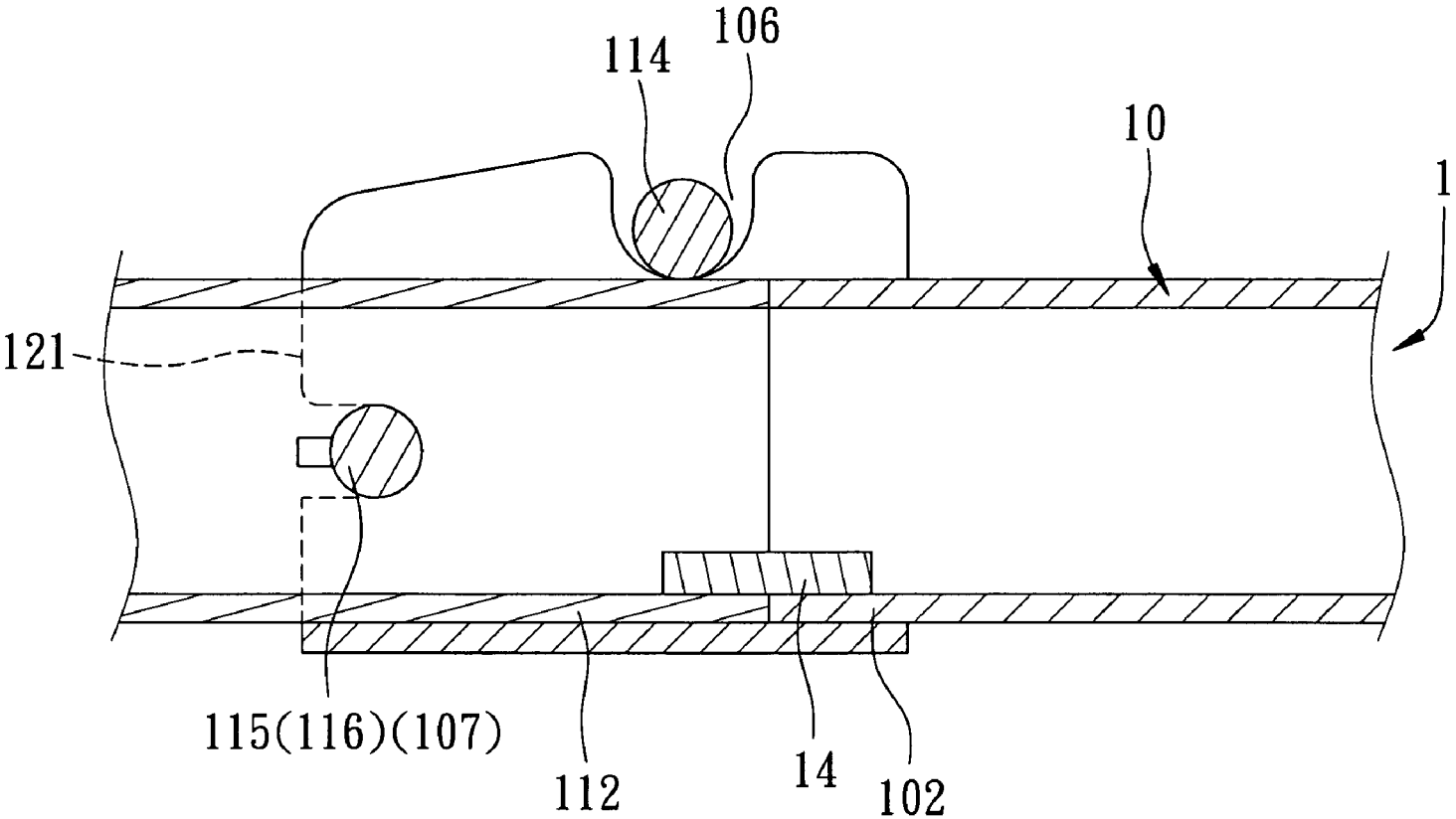
FIG. 11 is a fragmentary sectional view of the preferred embodiment, illustrating the foldable frame unit in the unfolded state.

As shown in FIG. 10 and FIG. 11, the securing shaft 115 is guided along the guide segments 121 of the guiding edges 105 of the inverted U-shaped bracket 103 of the respective first end part 102 of the first frame section 10 toward the securing notches 107. Due to the restoring force of the bed unit 4, the securing shaft 115 is guided along the first notch-confining segments 122, and is subsequently received securely in the securing notches 107 such that the bed body 41 is stretched tensely over the bedding space 12 (see FIG. 3). Simultaneously, the positioning plate 14 on each second end part 112 extends into and abuts against the corresponding first end part 102. Therefore, it has been shown that the coupling shaft 114 and the securing shaft 115 cooperate with the first end part 102 of the first frame section 10 to secure the foldable frame unit 1 in the unfolded state (as shown in FIG. 13).

Figure 12:
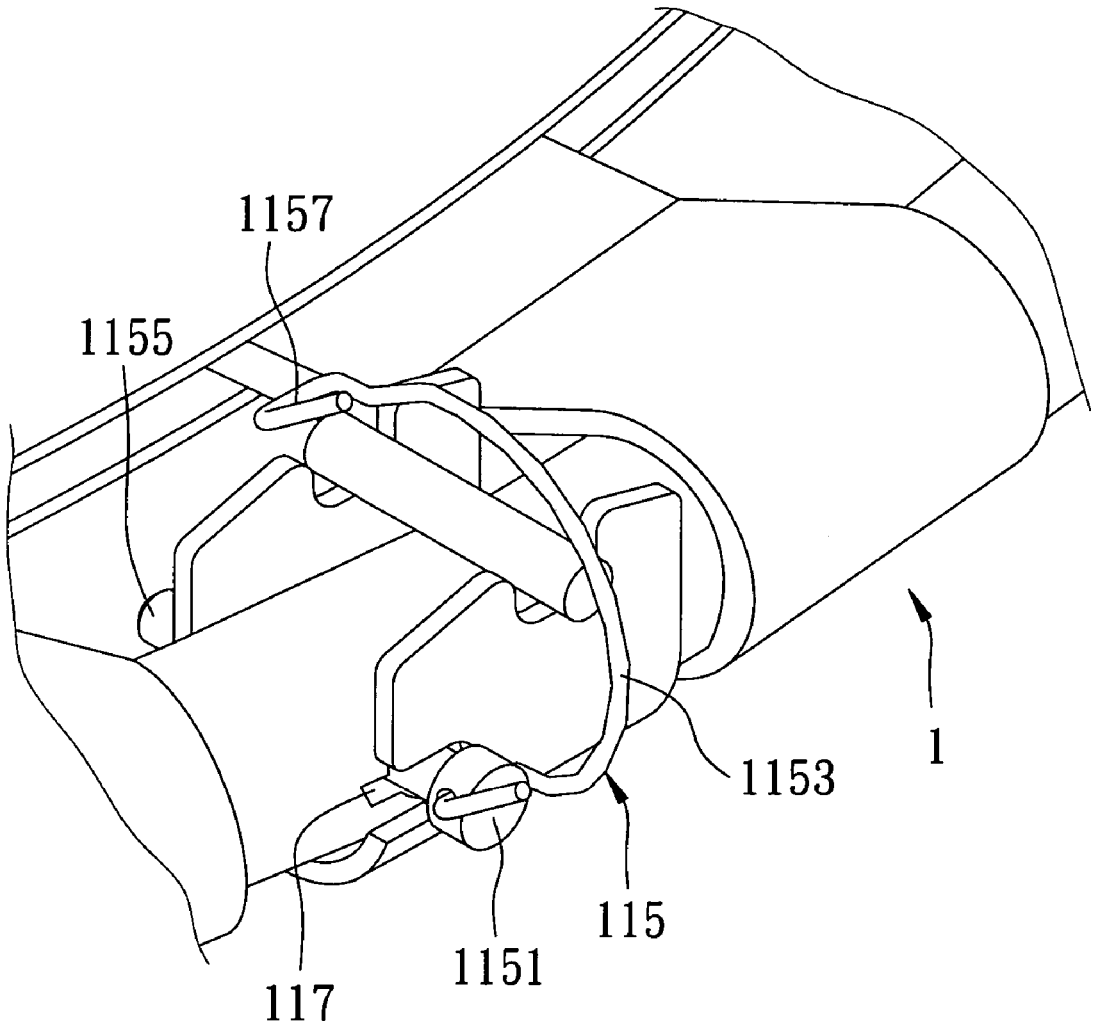
FIG. 12 is an enlarged fragmentary perspective view of the preferred embodiment, illustrating a first step in moving the foldable frame unit from the unfolded state to the folded state.
Figure 14:
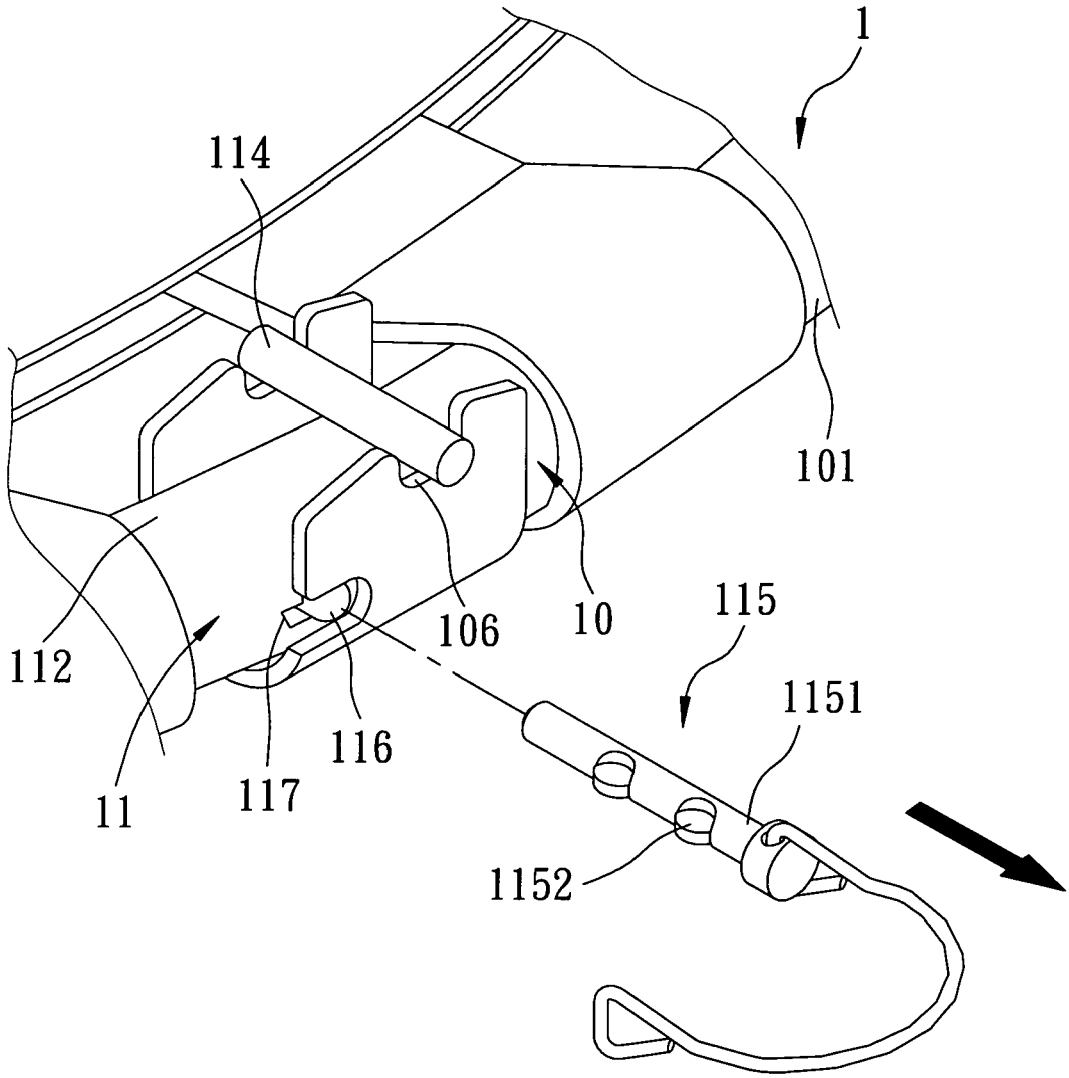
FIG. 14 is an enlarged fragmentary perspective view of the preferred embodiment, illustrating removal of the securing shaft from the second end part of the second frame section.

As shown in FIG. 12, when the foldable frame unit 1 is operated to move from the unfolded state back to the folded state, the second pin portion 1157 of the safety pin 1153 of the securing shaft 115 is taken off the second end 1155 of the shaft body 1151, and the shaft body 1151 is turned at an angle such that the securing protrusions 1152 (see FIGS. 4 and 6) are aligned with the nicks 117. As shown in FIG. 14, the shaft body 1151 is subsequently operated to move out of the second end part 112 of the second frame section 11 via the securing openings 116, at which time the first and second frame sections 10, 11 can be disassembled from each other and folded one on top of the other. As shown in FIG. 15, when the first and second frame sections 10, 11 are folded one on top of the other, the first and second frame sections 10, 11 can be folded further due to the pivot connections of the first frame rods 101 and the second frame rods 111 to further reduce the size of the foldable trampoline in order to facilitate storage and transport.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. A foldable trampoline comprising:

a bed unit including a bed body and a plurality of anchoring components connected to a periphery of said bed body; and a foldable frame unit operable to move between an unfolded state and a folded state, and including first and second frame sections that cooperate to define a bedding space, that are coupled movably to each other, that have said anchoring components of said bed unit coupled thereto, and that include first and second end parts, respectively;

wherein said bed body of said bed unit is stretched tensely over said bedding space when said foldable frame unit is in the unfolded state;

wherein said first end part of said first frame section has a coupling edge indented to form a coupling notch that opens in a direction away from said bed body, and a guiding edge extending from said coupling edge and indented to form a securing notch that opens toward said second end part of said second frame section when said foldable frame unit is in the unfolded state;

wherein said second end part of said second frame section is provided with a coupling shaft to be received movably in said coupling notch in said coupling edge of said first end part of said first frame section, and a securing shaft to be received in said securing notch in said guiding edge of said first end part of said first frame section;

wherein, when said coupling shaft is extended into said coupling notch, and said foldable frame unit is operated to move from the folded state to the unfolded state, said securing shaft is guided along said guiding edge of said first end part of said first frame section and is subsequently received in said securing notch such that said coupling shaft and said securing shaft cooperate with said first end part of said first frame section to secure said foldable frame unit in the unfolded state;

wherein said second end part of said second frame section is tubular and is formed with an aligned pair of securing openings and two radial nicks in spatial communication with said securing openings, respectively;

wherein said securing shaft includes a shaft body and a plurality of radial securing protrusions mounted on said shaft body, said shaft body being operable to extend through said second end part of said second frame section via said securing openings such that said securing protrusions are extended into said second end part of said second frame section via said nicks; and wherein said securing protrusions prevent said shaft body from moving out of said second end part of said second frame section when said securing protrusions are misaligned with said nicks.

2. The foldable trampoline as claimed in claim 1, wherein:

said guiding edge of said first end part of said first frame section has a guide segment extending from said coupling edge, a first notch-confining segment extending from said guide segment in a direction away from said second end part of said second frame section when said foldable frame unit is in the unfolded state, a notch end segment extending from said first notch-confining segment, and a second notch-confining segment extending from said notch end segment in a direction toward said second end part of said second frame section when said foldable frame unit is in the unfolded state, said first and second notch-confining segments cooperating with said notch end segment to define said securing notch, said first notch-confining segment being inclined relative to said second notch-confining segment such that said securing notch gradually diverges in the direction toward said second end part of said second frame section when said foldable frame unit is in the unfolded state.

3. The foldable trampoline as claimed in claim 1, wherein said shaft body has first and second ends, and said securing shaft further includes a curved safety pin having a first pin portion connected pivotally to said first end of said shaft body, and a second pin portion hooked removably onto said second end of said shaft body.

4. The foldable trampoline as claimed in claim 1, wherein said first end part of said first frame section is provided with an inverted-U-shaped bracket that has said coupling edge and said securing edge.

5. The foldable trampoline as claimed in claim 1, wherein each of said first and second end parts of said first and second frame sections is tubular, one of said first and second end parts being provided with a positioning plate that extends into and that abuts against the other one of said first and second end parts when said foldable frame unit is in the unfolded state.

6. The foldable trampoline as claimed in claim 1, wherein each of said first and second frame sections includes pivotally connected frame rods, said first and second end parts being provided on said frame rods of said first and second frame sections, respectively.

7. The foldable trampoline as claimed in claim 1, wherein said foldable frame unit further includes a plurality of supporting legs connected to said first and second frame sections.

8. The foldable trampoline as claimed in claim 1, wherein said first end part of said first frame section has a rounded corner between said coupling edge and said guiding edge.

* * * * *